United States Patent [19]

Johansen

[11] 4,455,710

[45] Jun. 26, 1984

[54] ELONGATED WINDOW MOUNTING MEMBER HAVING A PIVOT POINT AND A SHORT SLIDE RAIL SECTION

[75] Inventor: Jan Johansen, Oslo, Norway

[73] Assignee: A/S Grorud Jernvarefabrik, Oslo, Norway

[21] Appl. No.: 351,565

[22] Filed: Feb. 23, 1982

[30] Foreign Application Priority Data

Mar. 13, 1981 [NO] Norway ..... 810871

[51] Int. Cl.[3] ..... E05D 15/28

[52] U.S. Cl. ..... 16/221; 49/252

[58] Field of Search ..... 49/246, 250, 251, 252, 49/388; 16/221

[56] References Cited

U.S. PATENT DOCUMENTS

| | | | |
|---|---|---|---|
| 1,614,166 | 1/1927 | Whitney | 49/251 X |
| 2,932,848 | 4/1960 | Ahlgren | 49/251 X |
| 3,117,351 | 1/1964 | Ahlgren | 49/252 |
| 3,345,777 | 10/1967 | Anderberg et al. | 49/250 X |
| 4,080,758 | 3/1978 | Hubbard | 49/390 |
| 4,306,377 | 12/1981 | Sterling et al. | 49/250 |

*Primary Examiner*—Fred Silverberg

*Attorney, Agent, or Firm*—Pollock, Vande Sande & Priddy

[57] ABSTRACT

A mounting assembly for sliding hinge-mounted windows is described, of the type which includes a pivot point for one end of one huge arm and a slide rail for a slide shoe on the other hinge arm. A short section of the slide rail and the pivot point are located on a separate casting which also comprises various detail elements for ensuring correct placement of the casting in the window frame when it is mounted therein.

6 Claims, 4 Drawing Figures

ELONGATED WINDOW MOUNTING MEMBER HAVING A PIVOT POINT AND A SHORT SLIDE RAIL SECTION

FIELD OF THE INVENTION

The present invention relates to a mounting assembly for windows mounted on a sliding hinge, especially windows hinged at the side, wherein the window is supported by hinge arms connected to the window sash and, respectively, to a pivot point and a slide rail on the window frame.

BACKGROUND OF THE INVENTION

Many different embodiments of mountings for sliding-hinge windows may be found, but common to most of them is that one of the arms is pivotally connected to the window frame at one point and the other arm is slidable on a slide rail which guides the movement of the end of the arm. The previously known mountings and hinges for windows of this type, however, have the drawback that they are only suitable for series production in large numbers for windows of a specific dimension, to which the hinge and slide rails are then adapted, and should a need arise for a smaller number of windows, or perhaps for just one special window, the reorganization of production and adjustment of hinges and mountings which are entailed are so extensive that the windows become unreasonably expensive.

Another drawback with windows in which the point of attachment for one arm of the hinge and the slide rail for the other arm disposed in respective parts of the frame, is the problem of keeping the distance between the pivot point and the slide rail sufficiently accurate. A variation in this distance, be it ever so small, will lead to problems with proper sealing of the window when it is closed.

SUMMARY OF THE INVENTION

The object of the present invention is to arrive at an assembly whereby the above-mentioned drawbacks are overcome, and in particular an assembly which makes it possible to produce slide rails and the wooden frame components for a window in full running lengths, which can then simply be divided into suitable lengths as needed for any window dimension whatsoever, while at the same time the distance between the slide rail and said pivot point is permanently fixed so that the sealing will also be satisfactory.

In accordance with the invention, this is obtained in that the assembly comprises a casting, preferably of metal, which has a pivot point or point of attachment for one arm of the hinge and a short section of the slide rail for the slide shoe connected to the other arm. The casting is intended to be fastened in the corner at the bottom of the frame on the side of the window at which the window sash is hinged, and owing to projections and stop elements provided thereon the casting will automatically assume the correct position, and it also has surface of abutment for the continuation of the slide rail. The part of the slide rail located on the casting need only be long enough to provide space for the slide member on the arm, which means a couple of centimeters at most.

BRIEF DESCRIPTION OF THE DRAWINGS

The invention is characterized by the features recited in the appurtenant patent claims, and will be explained further in the following with reference to the accompanying drawings, wherein

DESCRIPTION OF PREFERRED EMBODIMENTS

For the sake of clarity, the hinge itself is not illustrated, but a person skilled in the art will be familiar with how such hinges are installed between the window frame and sash since, as mentioned above, there are a large number of different embodiments available, and such hinges have been extensively described in technical literature and patent specifications.

The mounting assembly in accordance with the invention comprises a casting of suitable material, e.g., metals such as Silumin (Alpax) and other aluminum alloys, or zinc and zinc alloys.

Figure 1:
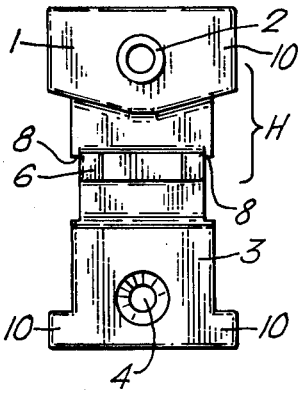
FIG. 1 shows a casting, seen from above.

The casting has a step 1 in which a bearing bushing 2 has been cast, which forms a point of attachment for one end of one of the arms of the hinge. The casting also has a surface 3 with a hole for a fastening screw 5 (FIG. 3), and interposed between the step 1 and the surface 3 is a short section 6 of the slide rail. Since the casting is made of a suitable metal, it can be molded very accurately; therefore, the distance between the bushing 2 which forms the pivot point for one hinge arm and the slide rail section 6 for the other arm is fixed very accurately, rendering it unnecessary to undertake careful measurement of this distance when the window is being mounted. This distance is indicated by the letter H in FIG. 1. The slide rail itself continues over a substantial portion of the width, or the height, of the window frame, depending respectively on whether the window is hinged at the side or at the top, and on FIG. 2 one end of the slide rail 7 is shown as it is being brought together with the casting. The casting has a surface of abutment 8 for the edge 9 of the slide rail 7 so that the leading edge of the slide rail, during mounting, will automatically come into correct alignment with the slide rail section 6 on the casting.

Figure 2:
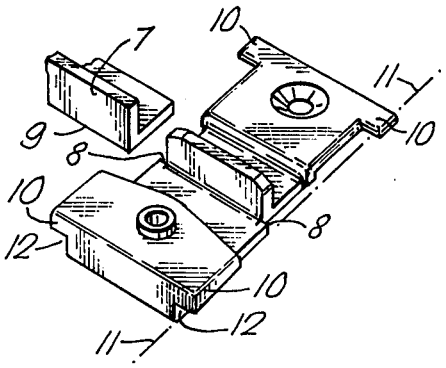
FIG. 2 shows the casting seen slightly in perspective together with the end of a slide rail.
Figure 3:
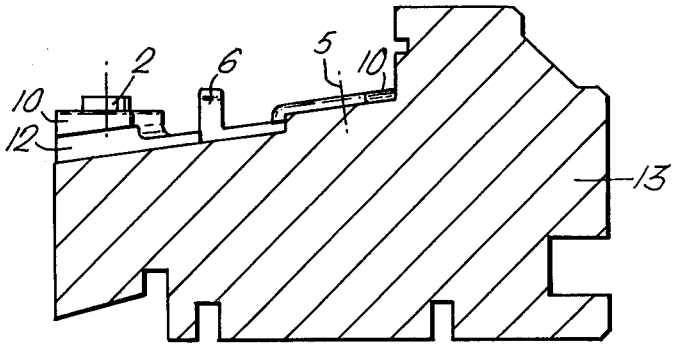
FIG. 3 shows in cross section a window frame with the casting installed thereon.

At the sides, the casting has projections 10 which are brought into contact against the window frame in a corner, indicated by the dotted-dashed line 11 in FIG. 2, and the casting is then in correct position for being fastened by means of the screw 5 through the hole 4, as shown in FIG. 3. The projection 10 on the outwardly-facing step 1 does not extend down to the underlying frame, thus forming a channel 12 which allows moisture, for example driving rain, to escape.

Figure 4:
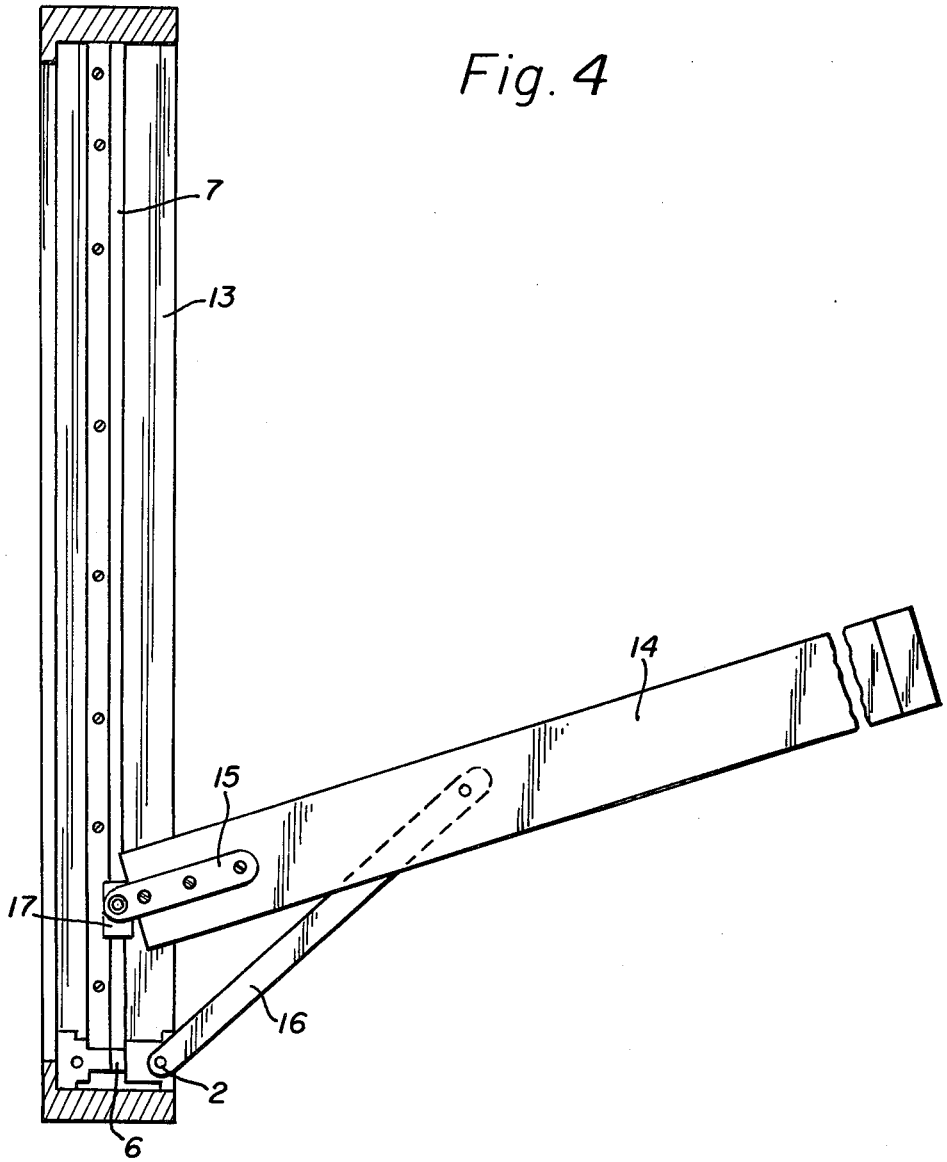
FIG. 4 shows the casting, the slide rail, the window sash, the window frame, and the hinge arms connecting the window sash to the window frame.

FIG. 4 shows the elongated casting member, the slide rail 7, the window sash 14, the window frame 13, and the hinge arms 15 and 16 connected at one end to the window sash and at the other end, respectively, to the pivot point at bushing 2 and to slide shoe 17 which is slidable onto slide rail section 6 on the casting.

As may be seen in FIG. 3, the shape of the casting is naturally adapted to the cross-sectional configuration of the window frame 13, and may vary from one type of window to another. Thus, the embodiment described hereinabove is only intended to serve as an example of the invention, and other embodiments may easily be imagined which would be within the scope of the invention, as long as the casting can be mounted separately from the slide rail itself, and has a short section or an extension of this rail together with some form of pivotal support for one arm of the window hinge.

With the assembly according to the invention, it is possible in a simple manner to produce windows from materials which have been given a particular profile configuration and are available in full running lengths ready for use. When the window sash and frame are being assembled, the casting of the invention is positioned in the appropriate corner with the projections in contact with portions of the frame, thereby determining the positioning of the slide rail, while at the same time the distance between the rail and the pivot point is constant so that one always obtains a good seal when the window is closed.

Having described my invention, I claim:

1. A mounting assembly for a sliding window sash supported in a window frame by two hinge arms which are connected at one end to the window sash and at the other end, respectively, to a fixed pivot point and to a slide shoe on a slide rail in the window frame, said assembly comprising a separate elongated member extending transversely to the direction of movement of the slide shoe on the slide rail and having a longitudinal axis and means for mounting said member in said window frame, said member including:

means for attaching one of said hinge arms to said window frame so as to provide the fixed pivot point for said one hinge arm; and, a separate section of said slide rail for slidably receiving said slide shoe on the other of said hinge arms, said slide rail section extending transversely to said elongated member at a fixed distance from the fixed pivot point for said one hinge arm and said separate section and the attaching means being spaced in the direction of the longitudinal axis of the elongated member.

2. An assembly according to claim 1 in which the member has a transversely offset surface of abutment for an edge of another slide rail section abutting said separate slide rail section.

3. An assembly according to claim 1 in which the member has transversely, outwardly-extending projections for contacting the window frame so as to position the member relative to the window frame in which the member is mounted.

4. An assembly according to claim 3 in which at least some of said projections face toward the outside of the window frame and have recesses on the underside therefore for providing channels for the escape of moisture from driving rain and the like.

5. An assembly according to claim 1 in which a bottom face of the member is adapted to the cross-sectional configuration of the window frame.

6. An assembly according to claim 1 in which said member is mounted on one side of said window frame so as to provide a hinge at the side of said window sash.

* * * * *